US006314663B1

(12) United States Patent
Saldana

(10) Patent No.: US 6,314,663 B1
(45) Date of Patent: Nov. 13, 2001

(54) SHOE CUSHIONING SYSTEM

(76) Inventor: Frank Saldana, 3153 Maury St., Richmond, VA (US) 23224

( * ) Notice: Subject to any disclaimer, the term of this patent is extended or adjusted under 35 U.S.C. 154(b) by 0 days.

(21) Appl. No.: 09/546,425

(22) Filed: Apr. 10, 2000

(51) Int. Cl.[7] ..... A43B 13/18; A43B 13/20; A43B 21/26; A43B 7/14

(52) U.S. Cl. ..... 36/28; 36/29; 36/35 B; 36/88; 36/93

(58) Field of Search ..... 36/28, 29, 35 B, 36/8.4, 153, 155, 88, 93, 114

(56) References Cited

U.S. PATENT DOCUMENTS

| | | | | |
|---|---|---|---|---|
| 1,313,924 | * | 8/1919 | Stewart | 36/153 |
| 3,876,746 | * | 4/1975 | Hanson | 36/93 |
| 4,120,064 | * | 10/1978 | Salomon | 36/93 |
| 5,222,312 | * | 6/1993 | Doyle | 36/28 |
| 5,253,435 | * | 10/1993 | Auger et al. | 36/88 |
| 5,400,529 | * | 3/1995 | Bell et al. | 36/93 |
| 5,416,988 | * | 5/1995 | Potter et al. | 36/89 |
| 5,456,027 | | 10/1995 | Tecchio et al. . | |
| 5,588,227 | | 12/1996 | Goldston et al. . | |
| 5,590,696 | | 1/1997 | Phillips et al. . | |
| 5,765,298 | * | 6/1998 | Potter et al. | 36/89 |
| 5,867,842 | | 2/1999 | Pinsley et al. . | |
| 5,930,918 | | 8/1999 | Healy et al. . | |
| 5,996,253 | * | 12/1999 | Spector | 36/28 |
| 6,026,595 | * | 2/2000 | Curry | 36/93 |

* cited by examiner

*Primary Examiner*—Anthony Stashick
(74) *Attorney, Agent, or Firm*—Norman B. Rainer

(57) ABSTRACT

A shock-absorbing athletic shoe system for cushioning impact forces includes an athletic shoe having a flexible impervious bladder positioned within the sole of the shoe. An external fluid-holding surge tank communicates by way of a fluid conduit with the bladder of each shoe. Quick release connectors are interactive between the lowermost extremities of the fluid conduits and the shoes.

17 Claims, 1 Drawing Sheet

SHOE CUSHIONING SYSTEM

BACKGROUND OF THE INVENTION

1. Field of the Invention

This invention generally relates to the field of footwear and more particularly to athletic footwear. Specifically, the present invention relates to athletic footwear which incorporate at least one cushioning bladder for adjusting the comfort and fit of the shoe, and auxiliary apparatus which augments the effectiveness of said bladder.

2. Description of the Prior Art

A typical athletic shoe includes an outsole, a midsole overlying the outsole, and an upper secured to the midsole. The midsole is generally made of a resilient foam material, such as ethylene vinyl acetate (EVA) or polyurethane (PU), which provides at least some cushioning and support to the athlete's foot. Some midsoles have recesses formed therein for containing resilient pads or fluid filled bladders. Fluid filled bladders are frequently positioned in the heel areas of shoe soles since, in a normal walking or running gait, the heel area of the foot usually strikes the ground first at each footfall. However, fluid filled bladders or cushioning pads may be positioned in other areas of the shoe and shoe sole that accept significant external forces during use.

Many prior art fluid filled bladders have been filled with a gas, such as air, while others have been filled with liquids or viscous gels. Air filled bladders provide good shock absorption of relatively light external loads through compression of the air. As the air compresses, the resistance of the bladder increases. However, one disadvantage of prior art air filled bladders is that they fail to provide adequate shock absorption in response to extreme external forces. Under extreme loads, the walls of air filled bladders have a tendency to "bottom out" against one another. Thus, there is a need for a cushioning system that provides good shock absorption in response to light external loads, and which is capable of accepting extreme loads with minimal propensity toward "bottoming out."

Another disadvantage of prior art air filled bladders is that they have a tendency to lose air. The typical plastic bladder allows some permeation of air. When a higher air pressure exists on the inside of the bladder, which is usually the case during normal loading of the shoe sole, the air contained within the bladder tends to leak through the bladder walls over time.

In order to increase both the comfort and fit of the footwear, manufacturers have incorporated inflatable bladders of various designs into the construction of the footwear. The development, incorporation, and use of inflatable air bladders within athletic footwear was and is particularly appropriate for ski boots used for downhill skiing. Thus, a number of patents relate to the field of ski boots which incorporate inflatable air bladders, for example, German Patent No. 2,162,619, and more recently U.S. Pat. No. 4,662,087. While the original designs for ski boots having air bladders incorporated the use of an external pressurizing device such as a hand pump, more recent designs incorporate the design of the pump into the article of footwear, such as for example the ski boot of U.S. Pat. No. 4,702,022.

The demands for comfort and snugness of fit in other athletic events has resulted in the use of the inflatable bladders originally developed for ski boots in various types of athletic footwear, including athletic shoes used for basketball and other sports. There are presently available athletic shoes incorporating an air pump, such as depicted within U.S. Pat. No. 5,074,765, to inflate air bladders located within the sole of the shoe, or alternatively, bladders located in portions of the upper or the tongue of the athletic shoe. The advantages of these types of shoes is manifested primarily by their increased comfort and the secure positioning or fit of the foot within the shoe. Another benefit derived from the use of air bladders is the potential for reduction of forces transmitted through the shoe to the foot and ankle of the wearer during performance of the athletic endeavor. Thus, current athletic shoes having incorporated air bladders provide enhanced comfort and fit, while also reducing the occurrence of various types of injuries.

For the athletic shoes currently available which incorporate both the inflatable air bladders and a pump inflation means, the comfort and fit of the article of footwear is adjusted by inflating the air bladder by use of the pump after securing the footwear about the foot. The wearer simply inflates the air bladder until a particular pressure level, or fit, is felt by the foot. A pressure gauge may be associated with such shoes, as disclosed in U.S. Pat. No. 5,588,227 to facilitate consistent pressurization.

Although shoes of the aforesaid nature provide shock-absorbing effectiveness, the limited space available within the sole for a bladder causes compromises with respect to adjustability of effect versus the bottoming out phenomenon.

It is accordingly an object of the present invention to provide a shoe cushioning system which utilizes auxiliary apparatus to augment the effectiveness of a bladder within an athletic shoe.

It is a further object of this invention to provide apparatus as in the foregoing object that permits adjustability of the response of the bladder to impact forces.

It is another object of the present invention to provide apparatus of the aforesaid nature which is easily attached to and removed from an athletic shoe.

It is a still further object of this invention to provide apparatus of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a shock-absorbing athletic shoe system comprising:

a) an athletic shoe having a sole and a flexible impervious bladder positioned within said sole,
b) an external fluid-holding surge tank of variable volume equipped with a valve that controls passage of fluid into and out of said surge tank, and resiliently biased plunger means for adjusting the volume of said surge tank,
c) a fluid conduit that extends in communication between said surge tank and the bladder of each shoe, and
d) quick release connector means interactive between said fluid conduit and associated bladder.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
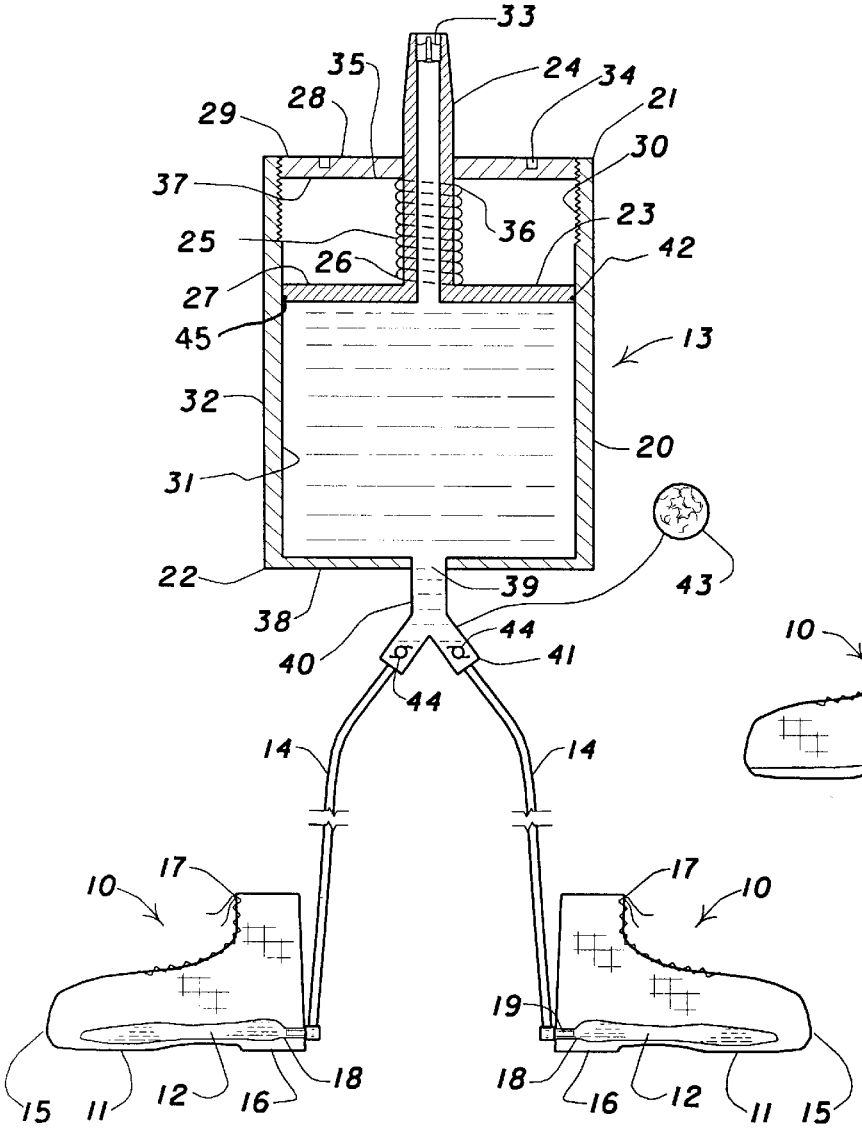
FIG. 1 is a schematic view of an embodiment of the shock-absorbing shoe system of the present invention.

Referring now to FIG. 1, an embodiment of the shock-absorbing shoe system of the present invention is shown comprised of an athletic shoe 10 having a sole 11 and bladder 12 incorporated within the sole, an external fluid-holding surge tank 13 and fluid conduits 14 which communicate between said surge tank and bladders.

In addition to said sole, shoe 10 has toe, heel and upper portions 15, 16 and 17, respectively. Bladder 12 preferably communicates with the exterior of said heel portion by way of a transfer tube 18. Lower connector means, which may be in the form of a plastic barbed tubing connector 19, is removably associated with the rearward extremity of transfer tube 18. Alternative embodiments of said lower connector means include, for example, quick-disconnect connectors which achieve joinder and separation by in-line movement of two interactive components while achieving simultaneous sealing of the tubing associated with the disconnected components. An example of such quick-disconnect connectors, sometimes referred to as a "shut-off" connector, is STAT-O-LOK disconnector sold by Bel-Art Products of Pequannock, N.J.

The exemplified embodiment of surge tank 13 includes a rigid reservoir cylinder 20 having a bottom panel 38 integral with circular cylindrical sidewall 32 having upper and lower extremities 21 and 22, respectively. A tight-fitting piston panel 23 is slideably disposed within said cylinder. The circular edge 42 of piston panel 23 contains a recessed groove which secures a lubricated O-ring 45 that engages interior surface 31 in air-tight sliding relationship. An inflation stem 24 is upwardly emergent from the center of panel 23, and includes an inflation valve 33 of the type employed in automotive pneumatic tires. A coil spring 25 is disposed upon stem 24. The lower extremity 26 of said spring rests in abutment upon the upper surface 27 of panel 23.

A disc-shaped nut 28 slideably seated upon stem 24 has a threaded perimeter 29 that engages corresponding threading 30 on the interior surface 31 of sidewall 32. Depressions 34 are disposed within the upper surface 35 of nut 28 to facilitate rotation thereof by use of a spanner wrench. The upper extremity 36 of spring 25 abuts against the underside 37 of nut 28. By virtue of such construction, the effective volume of surge tank 13 can be adjusted while permitting an elastic response to pressure within cylinder 20. The nature of such elastic response can be changed by employing coil springs of different force characteristics. Said surge tank may have configurations other than the exemplified cylindrical shape, although the reservoir function of the surge tank should involve a construction that is non-resilient except for the use of pressure controlling means such as a coil spring or equivalent means interactive with the reservoir to adjust the volume thereof.

Bottom panel 38 has a centered discharge portal 39. Upper connector means in the form of Y-shaped tubing connector 40 is seated within portal 39 in a manner such that the bifurcated lower extremity 41 of said upper connector divides any fluid within the system into two equal flows. Paired conduits 14 emergent from connector 40 travel downwardly to joinder with lower connector means 19 and corresponding bladders 12. The inside diameter of each conduit should be between ⅛ and ⅜ inches. The conduit is preferably flexible polyethylene or nylon tubing of common availability. A pressure-indicating gauge 43 may be interposed at connector 40, or elsewhere in the system. Constrictor or metering valves 44 may also be associated with conduits 14.

Surge tank 13 and associated components may be worn at belt height by the user. In alternative embodiments, a separate surge tank may be associated with each shoe. When the surge tank is worn at waist level, the length of the downwardly directed conduits is such as to provide adequate slack for leg movement. It has been found that, to secure the advantages sought by the present invention, the volume of the surge tank should be at least 100% greater than of the volume of the bladder. Such relationship, when employed in conjunction with other features of this invention, is found to provide a consistent cushioning effect of greater amplitude and duration than obtainable with any prior bladder-equipped athletic shoe.

Figure 2:
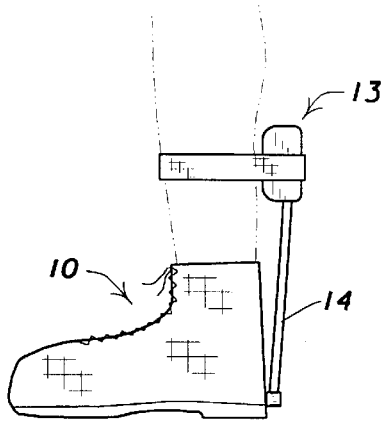
FIG. 2 is a side view of a second embodiment of the system of this invention.
Figure 3:
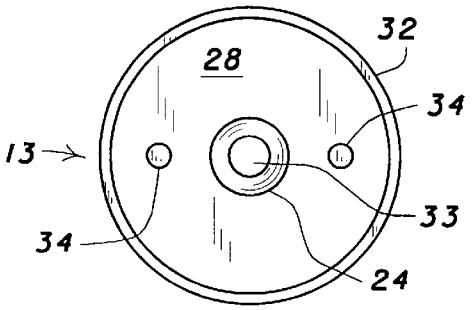
FIG. 3 is a top view of the surge tank component of the shock-absorbing shoe system of FIG. 1.

In the second embodiment exemplified in FIG. 2, a separate surge tank is associated with each shoe, and is strapped to the user's calf.

In use, the surge tank unit is secured in place on the user, and the lower connector means associated with each conduit 14 is caused to engage the bladder of the corresponding shoe. A fluid, preferably air, is then entered into said surge tank. In the case of air or other gas, the surge tank is pressurized by way of valve 33 to a pressure in the range of 3 to 15 pounds per square inch (psi) above atmospheric pressure. A hand-operated pump, such as employed to inflate bicycle tires, footballs and basketballs, may be employed for suitable pressurization. In the course of running or other high impact activity, the user will learn what degree of pressurization is most comfortable in terms of shock absorption and absence of bottoming out. Still further control of the response characteristics of the shock-absorbing apparatus is achieved by adjustment of the depth to which piston panel 23 is forced into cylinder 20 by rotation of nut 28. Such factors will obviously depend upon the user's weight, the nature of the high impact activity, and the depth of the bladder. With proper adjustment, the apparatus of this invention will enable the gas compressed by impact, and representing stored energy, to re-expand rapidly enough to impart thrusting force upwardly against the user's foot. Such action will enhance running, walking and jumping.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A shock-absorbing athletic shoe system comprising:

a) an athletic shoe having a sole, a heel portion having an exterior boundary, and a flexible impervious bladder positioned within said sole, b) an external fluid-holding surge tank of variable volume greater than 100% of the volume of said bladder equipped with a valve that controls passage of fluid into and out of said surge tank, and resiliently biased plunger means for adjusting the volume of said surge tank, c) a flexible tubing fluid conduit that extends in communication between said surge tank and bladder at said heel portion, and d) quick release connector means interactive between said flexible tubing and associated bladder.

2. The athletic shoe system of claim 1 wherein said bladder communicates with the exterior boundary of said heel portion by way of a transfer tube having a rearward extremity.

3. The athletic shoe system of claim 2 wherein said connector means is removably associated with the rearward extremity of said transfer tube.

4. The athletic shoe system of claim 3 wherein said connector means achieves joinder with and separation from said transfer tube by in-line movement with respect to said transfer tube.

5. The athletic shoe system of claim 4 wherein said connector means achieves simultaneous sealing of said bladder and fluid conduit when disengaged from said connector tube.

6. The athletic shoe system of claim 1 wherein said surge tank includes a rigid reservoir cylinder having a bottom panel integral with a circular cylindrical sidewall having upper and lower extremities and a cylindrical interior surface.

7. The athletic shoe system of claim 6 wherein a tight-fitting piston panel is slideably disposed within said cylinder, said panel having an upper surface oppositely directed from said bottom panel.

8. The athletic shoe system of claim 7 wherein said piston panel has a circular edge which secures an O-ring that engages the interior surface of said cylindrical sidewall in air-tight sliding relationship.

9. The athletic shoe system of claim 7 wherein an inflation stem is upwardly emergent from the center of said piston panel.

10. The athletic shoe system of claim 9 wherein said inflation stem includes an inflation valve of the type employed in automotive pneumatic tires.

11. The athletic shoe system of claim 9 further including a coil spring disposed upon said inflation stem, said coil spring having an upper extremity and a lower extremity that rests in abutment upon said upper surface of said piston panel.

12. The athletic shoe system of claim 11 further including a disc-shaped nut slideably seated upon said inflation system, said nut having an upper surface and underside and having a threaded circular perimeter that engages corresponding threading on the interior surface of said cylindrical sidewall.

13. The athletic shoe system of claim 12 wherein the upper extremity of said coil spring abuts against the underside of said nut, whereby the effective volume of said reservoir cylinder can be adjusted while permitting an elastic response to pressure within said cylinder.

14. The athletic shoe system of claim 6 wherein said bottom panel has a centered discharge portal.

15. The athletic shoe system of claim 1 wherein a Y-shaped tubing connector is interactive with said surge tank, and secures paired fluid conduits which each travel downwardly to joinder with quick release connector means associated with each shoe of a pair of said athletic shoes.

16. The athletic shoe system of claim 1 wherein said fluid is air.

17. A shock-absorbing athletic shoe system comprising:

a) an athletic shoe having a sole terminating in a heel portion having an exterior boundary, and a flexible impervious bladder positioned within said sole, b) a surge tank equipped with a valve that controls passage of air into and out of said surge tank, the volume of said surge tank being at least 100% greater than the volume of said bladder, c) a conduit that extends in communication between said surge tank and the bladder of each shoe, and d) quick release connector means interactive between said conduit and associated bladder.

* * * * *